US009546065B2

(12) United States Patent
Mazzaccherini et al.

(10) Patent No.: US 9,546,065 B2
(45) Date of Patent: Jan. 17, 2017

(54) MACHINE FOR CLOSING THE TAIL END OF A ROLL OF WEB MATERIAL

(71) Applicant: FABIO PERINI S.P.A., Lucca (IT)

(72) Inventors: Graziano Mazzaccherini, Lucca (IT); Romano Maddaleni, Pisa (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 14/417,485

(22) PCT Filed: Jul. 12, 2013

(86) PCT No.: PCT/IB2013/055731

§ 371 (c)(1),
(2) Date: Jan. 26, 2015

(87) PCT Pub. No.: WO2014/016725

PCT Pub. Date: Jan. 30, 2014

(65) Prior Publication Data

US 2015/0191325 A1 Jul. 9, 2015

(30) Foreign Application Priority Data

Jul. 27, 2012 (IT) ..... FI2012A0156

(51) Int. Cl.
*B65H 19/29* (2006.01)

(52) U.S. Cl.
CPC ... *B65H 19/29* (2013.01); *B65H 2301/414421* (2013.01); *B65H 2301/414425* (2013.01); *B65H 2301/414428* (2013.01); *B65H 2301/414436* (2013.01); *B65H 2301/414446* (2013.01); *B65H 2406/3124* (2013.01); *Y10T 156/14* (2015.01)

(58) Field of Classification Search
CPC ..... B65H 19/29; B65H 2301/414421; B65H 2301/414428; B65H 2301/414446; B65H 2301/414425; Y10T 156/14
See application file for complete search history.

(56) References Cited

U.S. PATENT DOCUMENTS

| | | | | |
|---|---|---|---|---|
| 3,096,948 A | | 7/1963 | Conrad, Jr. | |
| 3,134,553 A | * | 5/1964 | De Gelleke | B65H 19/28 242/532 |
| 3,524,539 A | | 8/1970 | Herman | |
| 3,898,920 A | | 8/1975 | Zucker | |
| 3,960,272 A | * | 6/1976 | Hartbauer | B65H 19/29 156/184 |
| 4,097,983 A | | 7/1978 | Cole | |
| 5,242,525 A | | 9/1993 | Biagiotti | |
| 6,143,111 A | | 11/2000 | Biagiotti | |
| 7,846,286 B2 | | 12/2010 | Gelli | |
| 2007/0102552 A1 | | 5/2007 | Gambini | |
| 2010/0101705 A1 | | 4/2010 | Gelli et al. | |
| 2011/0265954 A1 | | 11/2011 | Gelli et al. | |

FOREIGN PATENT DOCUMENTS

| | | | | |
|---|---|---|---|---|
| CH | 690353 A5 | | 8/2000 | |
| DE | 19528264 A1 | | 11/1994 | |
| IT | WO 2006070431 A1 | * | 7/2006 | B65H 19/29 |
| WO | 2010000666 A1 | | 1/2010 | |

* cited by examiner

*Primary Examiner* — Jacob T Minskey
*Assistant Examiner* — Vishal I Patel
(74) *Attorney, Agent, or Firm* — Breiner & Breiner, L.L.C.

(57) ABSTRACT

The machine includes a first glue-applying device for closing the tail end; and a second mechanical-closing device for mechanically anchoring the tail end of the roll to a portion of an outer turn of the web material wound on the roll.

20 Claims, 14 Drawing Sheets

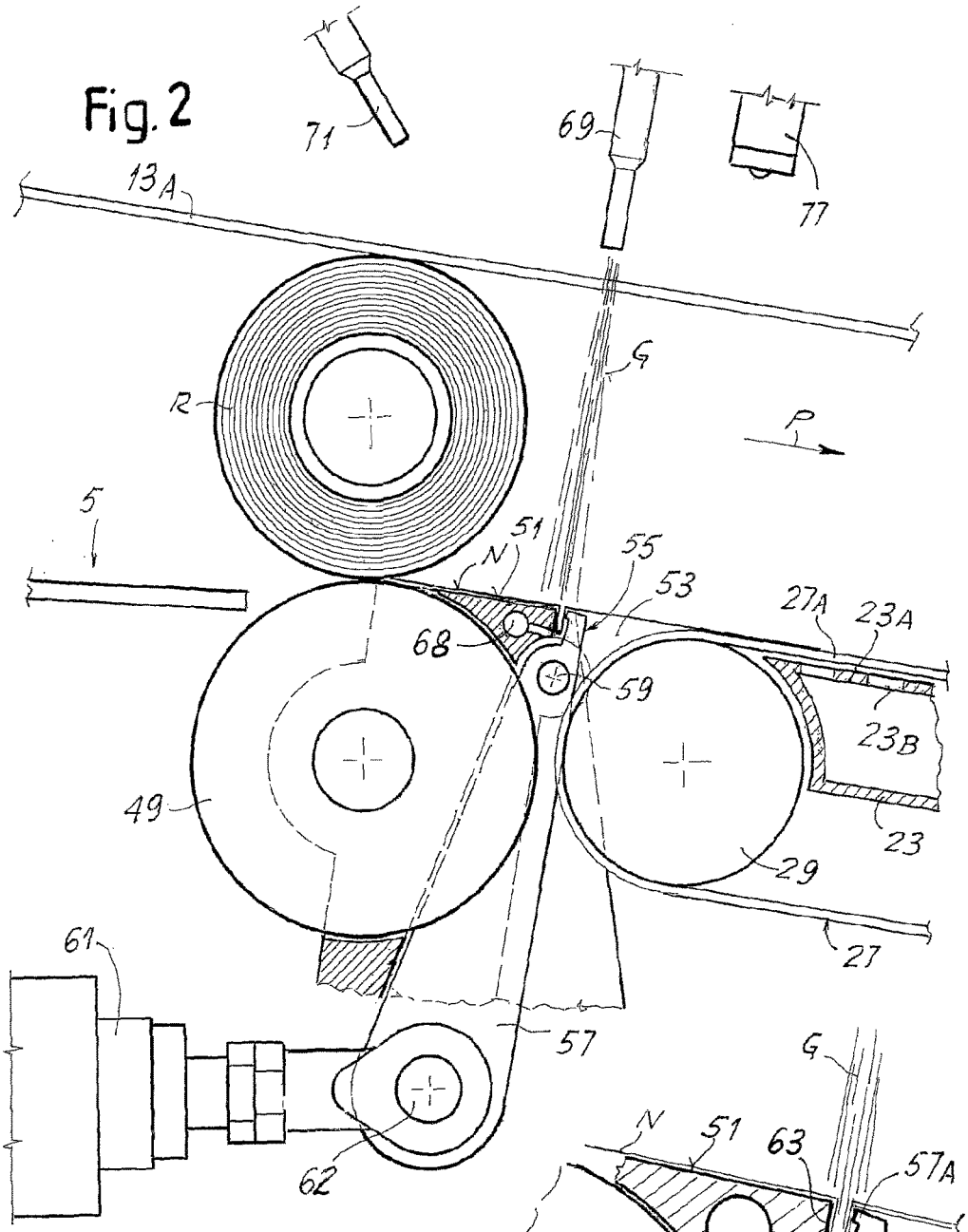
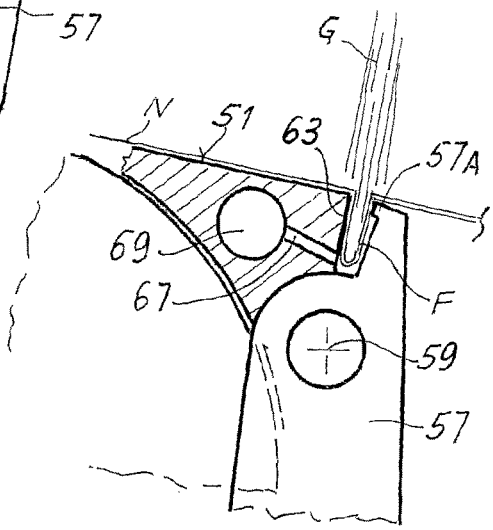
Fig. 3

VI
VI
91
93
96
89
99B
99A
97
92
94
102
P1

91
93
96
89
94
92
99B
99A
97
102
P1

MACHINE FOR CLOSING THE TAIL END OF A ROLL OF WEB MATERIAL

TECHNICAL FIELD

The present invention relates to machines and devices for converting web materials into rolls. More specifically, the present invention relates to machines for closing the tail end of rolls of web material, for instance rolls of tissue paper.

STATE OF THE ART

In the field of paper converting, in particular, although not exclusively, tissue paper for the production of rolls of toilet paper, kitchen towels and the like, it is well known to produce rolls or logs by winding one or more plies of web material, for instance by means of a rewinding machine. The tail end of these rolls shall be closed to prevent the web material from accidentally unwinding during the subsequent processing and converting operations, for instance during cutting of the logs into rolls of smaller axial dimensions, as well as during packaging.

Various types of machines for closing the tail end of rolls of web material by means of glue application are known. U.S. Pat. No. 5,242,525, U.S. Pat. No. 7,846,286, U.S. Pat. No. 6,143,111, and WO-A-201000666 disclose examples of these machines.

US-A-20100101705 and US-A-20110265954 disclose machines for sealing the tail end of rolls of web material without gluing it but rather joining it mechanically, through so-called mechanical ply-bonding systems.

SUMMARY OF THE INVENTION

The present invention relates to a machine for closing the tail end of rolls of web material, in particular, although not exclusively, tissue paper or other cellulose materials, allowing high productivity and greater flexibility.

According to one aspect, a machine is essentially provided for sealing the tail end of a roll of web material, comprising: a first glue-applying device for sealing the tail end with glue; and a second mechanical-closing device for mechanically joining the tail end of the roll to a portion of an outer turn of the web material wound on the roll. In advantageous embodiments mechanical bonding or joining is performed by pressing together the layers of web material with high compressive force. If the web material contains, or is made of, cellulose fibers, the localized pressure between plies or layers of the web material causes joining in the compression areas, as a result of a localized fiber fusion. This kind of mechanical joining is usually called mechanical ply-bonding.

This kind of anchoring or sealing is performed by pressing the tail end of the web material against a portion of web material of the last wound turn, this portion being folded for instance along three folding lines to project from the typically cylindrical surface of the roll. Mechanical bonding is therefore performed by pressing three layers of the web material together: two layers formed by the portion of material folded and projecting from the cylindric surface of the roll, and the third layer formed by the tail end. Clearly, each layer may comprise one or more plies of web material, for instance cellulose material, according to the number of plies forming the material.

With such a machine it is possible to select one of at least two operating modes, which differ in the different way of anchoring the tail end to the outer cylindrical surface of the roll. The two devices are preferably arranged and controlled to operate alternating with each other.

In some advantageous embodiments the second device comprises a plurality of mechanical ply-bonding members. The second device may comprise, for instance, a plurality of mechanical ply-bonding members aligned with one another according to a direction substantially parallel to the tail end of the roll of web material. Each mechanical ply-bonding member may comprise a mechanical ply-bonding roller. The mechanical ply-bonding rollers may cooperate with a single pressure surface, formed for instance by a crossbar fixed to the machine structure. The crossbar or other pressure surface may be formed by a single element or a plurality of adjacent elements. In other embodiments the mechanical ply-bonding rollers may cooperate with a plurality of pressure surfaces separate from one another. However, the use of a single or essentially continuous pressure surface, formed for example by a one-piece crossbar or by more elements aligned to form a crossbar, allows a more effective seal of the tail end, forming a substantially continuous mechanical bonding line along the entire, or at least a substantial part of the, width of the web material, i.e. axial length of the roll.

According to advantageous embodiments, each mechanical ply-bonding member may be arranged and controlled to move between one operative position and one idle position. In the idle position the free tail end of the roll may be sealed with glue by means of the first device.

An actuator, for instance a pneumatic or hydraulic actuator, may control switching from one position to the other. The same actuator may be used to apply the necessary force to press the layers of web material together for mechanical ply-bonding them. However, separate members may be also used: a first actuator to move the mechanical ply-bonding member(s) from an operative position to an idle position and vice versa; a second actuator to apply the necessary mechanical ply-bonding pressure. For the purpose of simplicity and cost reduction, it is preferable to use one actuator only.

In particularly advantageous embodiments of the invention, each mechanical ply-bonding member comprises at least one own actuator, separate from the actuators of the other mechanical ply-bonding members. This allows, for instance, to actuate the mechanical ply-bonding members selectively, and also to apply a calibrated adequate stress to each mechanical ply-bonding member. For example, in this way it is possible to balance changes, if any, in the thickness of the web material along the extension of the tail end and/or deformations, wears or parallelism tolerances of the pressure surface against which the mechanical ply-bonding members act.

In advantageous embodiments each mechanical ply-bonding member, for instance each mechanical ply-bonding roller, is carried by a respective slide. The slides may be advantageously provided with a synchronous motion parallel to the tail end of the roll. For instance, the slides may be mechanically connected to one another so as to move synchronously controlled by a single actuator, such as a cylinder-piston actuator, or an electric motor, or other servomechanism or actuator, arranged for example on a side of the machine. In other embodiments the slides may move by means of a transverse threaded bar engaging a plurality of nut screws, one for each slide. It is also possible to use one actuator for each slide, for instance an electric motor activating a pinion, engaging with a common rack. This arrangement allows the mechanical ply-bonding members to be actuated one independently of the other. However, by using one single actuator the structure is simpler, more reliable and less expensive.

Advantageously, each slide may carry an actuator for respectively: pushing the respective mechanical ply-bonding roller against a pressure and rolling surface, and moving the mechanical ply-bonding member into an idle position.

In some embodiments the mechanical ply-bonding rollers comprise: a first knurled annular portion, cooperating with the pressure and rolling surface; a second elastically yielding annular portion, cooperating with an embossing surface with an engraving. In this way, the web material pressed between the embossing surface and the second elastically yielding annular portion of the mechanical ply-bonding roller is embossed with a pattern according to said engraving. The engraving may be advantageously interchangeable. It may be provided for instance on a linear element, for example a bar or profile, easy to be removed and replaced. To this end, in advantageous embodiments a seat or housing may be provided for the linear element, below the pressure and rolling surface of the mechanical ply-bonding rollers. The linear element may be in a single piece. In other embodiments, to simplify construction and assembly, the linear element may be formed by a plurality of separate pieces or segments, mounted for example in a common seat.

In some advantageous embodiments, the first glue-applying device comprises a plurality of glue dispensing nozzles, arranged and controlled to apply glue on the tail end of the roll. The glue dispensing nozzles may be advantageously aligned in a direction essentially parallel to the roll tail end.

In some embodiments a respective mechanical ply-bonding member is associated with each glue dispensing nozzle. For instance, each slide carrying one of the mechanical ply-bonding members may be also provided with a glue dispensing nozzle. In this way the same actuator moving transversally the mechanical ply-bonding members may be used to move transversally the glue dispensing nozzles.

Preferably, on each slide a movable support is provided, for example an oscillating bracket carrying the mechanical ply-bonding member, for instance a mechanical ply-bonding roller. The movable support may be moved to bring the mechanical ply-bonding member alternatively into one operative position and one idle position. Preferably, the glue dispensing nozzle is not integral with the movable support carrying the mechanical ply-bonding member, but rather connected to the slide independently of the movable support. In this way the glue dispensing nozzle may be adjusted in position independently of the mechanical ply-bonding member. In some embodiments each glue dispensing nozzle has a fixed position with respect to the slide carrying it. In other embodiments each glue dispensing nozzle may be advantageously positioned in at least two positions on the slide carrying it. The two positions may be set so that the glue dispensing nozzle applies the glue on the tail end or alternatively in an area of the roll outer surface from which the tail end has been partially unwound, the tail end going over the glue when wound again.

According to some advantageous embodiments, at least one sensor is associated with the glue dispensing nozzle to detect the presence of the roll tail end, in order to automatically control the application of glue and avoid the machine being dirtied with glue when there is no web material in front of the glue dispensing nozzle. Preferably, two sensors are associated with each glue dispensing nozzle to detect the presence of the roll tail end. The two sensors are advantageously arranged at the sides of the nozzle, aligned in a direction substantially parallel to the tail end to be glued and therefore to the movement of the glue dispensing nozzle.

In some embodiments, the machine comprises a station for unwinding and positioning the tail end of the rolls, and a system to form and stabilize a fold of web material in an adequate position along the circumferential extension of the roll. More in particular, the folding system is arranged and controlled to form a fold at a distance from the tail end of the wound web material equal to the length of the outermost turn of the web material, and thus equal to the circumference of the roll, increased by a length equal to the length of the tail end that (after mechanical ply-bonding with the fold) will project from the roll cylindrical surface.

In advantageous embodiments, the system for forming and stabilizing the fold is arranged in correspondence of the unwinding station. The fold stabilizing system may comprise pneumatic members for sucking and/or generating air jets, so as to form a loop of web material inside a mechanical member for forming and stabilizing the fold.

Advantageously, when the machine is controlled to seal the tail end with glue, the fold is not formed.

In advantageous embodiments, the machine comprises a station for sealing the tail end of the roll, where both the first, glue-applying device and the second, mechanical closing device are arranged.

In advantageous embodiments the station where the tail end is unwound and positioned and the station where the tail end is sealed are arranged in sequence, the first station upstream and the second downstream of the roll feeding path.

Preferably, conveying members extend between these unwinding and positioning station and the sealing station; these members transfer the rolls from one station to the other, controlling the position of the tail end after it has been unwound and positioned in the first station. The conveying members may comprise continuous flexible upper and lower members, between which the roll feeding path is defined. A roll transferring surface may extend between the unwinding and positioning station and the sealing station. Along this transferring surface, which may be wholly or partially provided with a suction system to hold the tail end opened and stretched, a branch of a belt or other flexible member forming a conveyor for the rolls may extend. In some embodiments, along this surface two separate conveyors may be arranged in sequence, each comprising a respective continuous flexible member. The two conveyors may be controlled to have different speeds.

Also the upper conveying members may be subdivided into two, that is they may comprise two conveyors in sequence, which may be actuated at different speeds.

In advantageous embodiments, along the feeding path, in the area of the tail end sealing station, an opening, interruption or slot may be provided in the roll feeding surface. Through this opening, interruption or slot anchoring of the tail end of the roll may be performed, as described below. Essentially, each roll is moved forward toward this opening, interruption or slot provided in the feeding surface until the tail end enters said opening, slot or interruption, going below the feeding surface, for instance through a suction system or a system with air jets generated for example by one or more pressurized air nozzles.

The brief description above illustrates some characteristics of the various embodiments of the present invention, for better understanding the detailed description below and better evaluating the contribution of the invention to the state of the art. Further characteristics of the invention will be obviously described below and detailed in the attached claims. In this regard, before detailing the embodiments of the invention it is necessary to specify that they can be applied not only with the construction details and the component arrangements explained in the description below or illustrated in the drawings. Other embodiments are also possible, and the invention can be embodied and realized in various manner. It should be also specified that the terms and sentences used herein are only for description purposes and are no-limiting.

Moreover, it is also clearly apparent to those skilled in the art that the concepts, on which the invention is based, may be easily used as a base for designing other structures, methods and/or systems to achieve the various objects of the present invention. It is therefore important to understand that the claims are intended as comprising these equivalent embodiments, to the extent that they are not different from the concept and the object of the present invention.

BRIEF DESCRIPTION OF THE DRAWINGS

The present invention will be better understood by means of the description below and the attached drawing, which shows a non-limiting practical embodiment of the invention. More in particular, in the drawing:

FIG. 2 shows an enlargement of the area where the fold is formed on the outer surface of the roll;

FIG. 3 shows an enlargement of a detail in FIG. 2;

DETAILED DESCRIPTION OF EMBODIMENTS OF THE INVENTION

Figure 1:
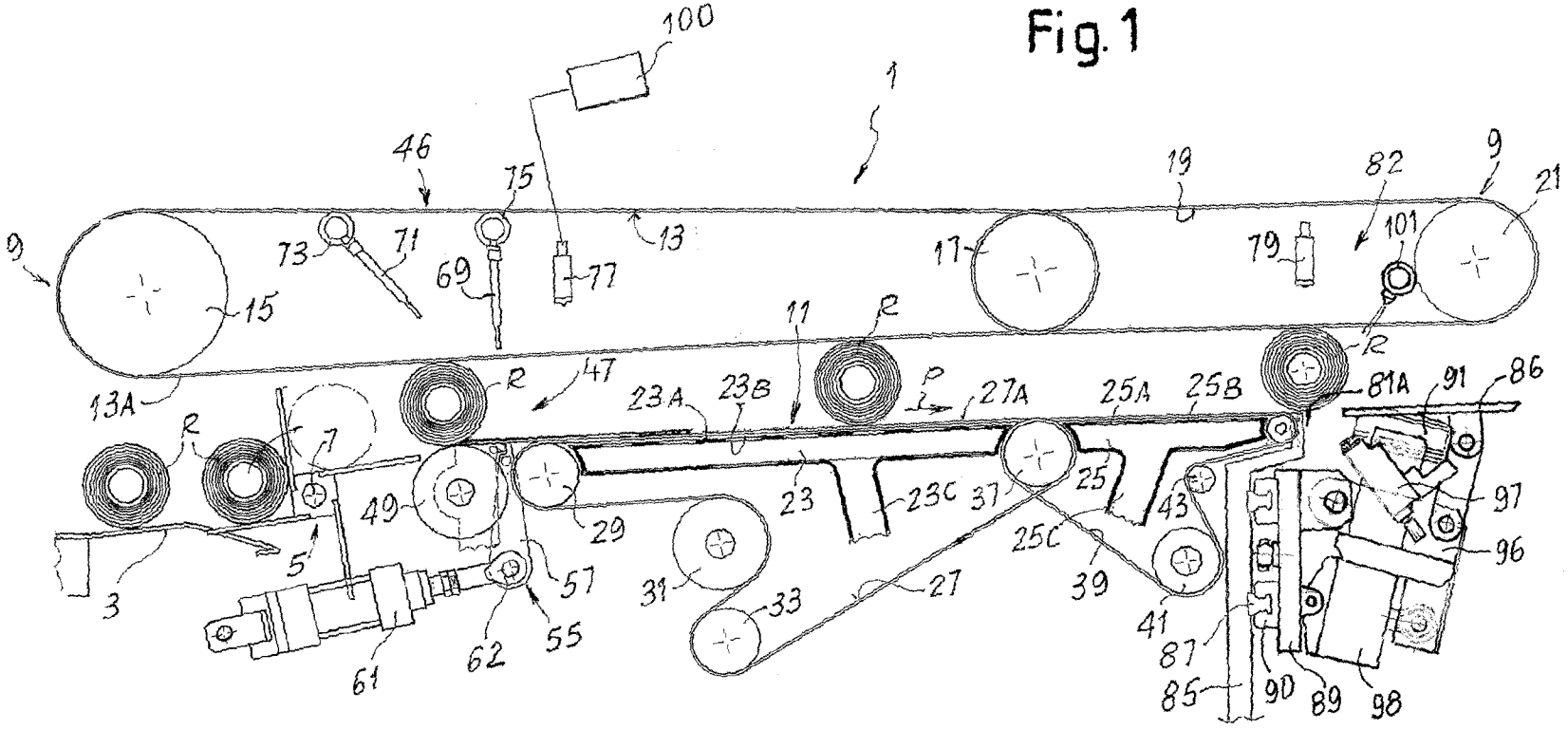
FIG. 1 shows a schematic side view of a machine in a possible embodiment.
Figure 4:
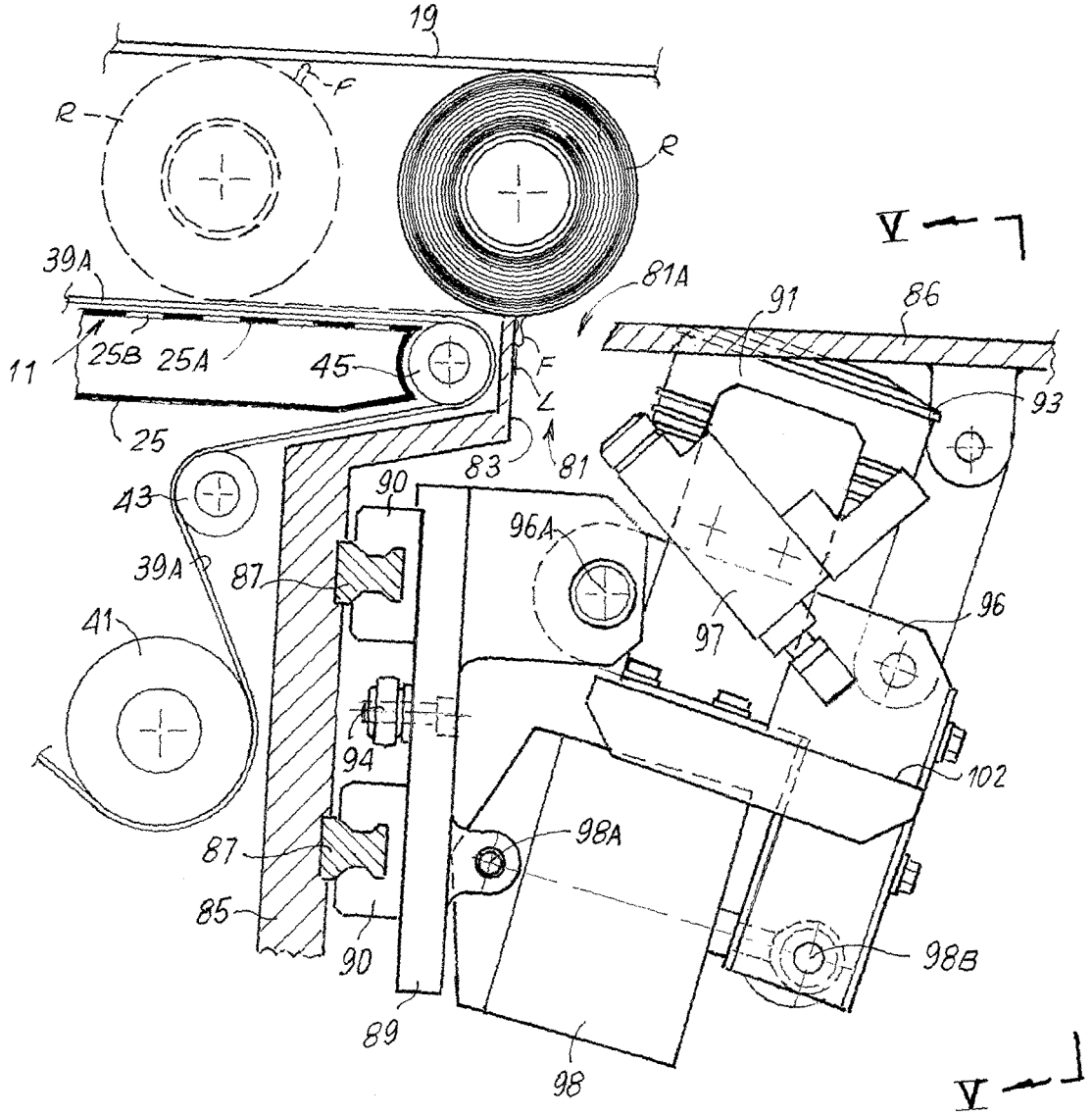
FIG. 4 shows an enlargement of the tail end sealing area.

The description below of some exemplary embodiments refers to the attached drawings. The same numbers in different drawings represent identical or similar elements. The drawings are not necessarily scaled. Moreover, the detailed description below does not limit the invention. On the contrary, the protective scope of the present invention is defined by the attached claims.

Throughout the description, the reference to "one embodiment" or "some embodiments" or similar or equivalent expressions indicates that a particular characteristic, structure or property described in relation to an embodiment is included in at least one embodiment or example of embodiment of the described invention. Therefore, the phrases "in one embodiment" or "in some embodiments" or analogous or equivalent expressions in different points of the description do not necessarily refer to the same embodiment or the same embodiments. Moreover, the particular characteristics, structures or elements can be combined in any adequate way in one or more embodiments.

With initial reference to FIGS. 1 to 5, number 1 indicates a whole machine for sealing the tail end of a web material, typically tissue paper, embodying the invention.

In one embodiment the machine 1 comprises an entrance chute 3, along which rolls or logs R are unloaded from a rewinding machine, an intermediate storage unit or any other unit arranged upstream along the converting line. Downstream of the chute 3 a dispenser 5 rotating around an axis 7 is arranged to pick up single rolls R and feed them inside a path P along which the rolls are variously processed to seal the tail end.

In one embodiment the path P extends between an upper conveying member, indicated as a whole with number 9, and a lower surface or lower structure supporting the rolls and indicated with 11, with which lower conveying members, described below, are associated.

In one embodiment the upper conveying member 9 comprises a first flexible member 13 driven around a first guide member 15 and a second guide member 17. The continuous flexible member 13 may consist of a series of parallel belts spaced from one another, each of which is driven around respective pulleys. The first guide member 15, as well as the second guide member 17, may be formed from a series of coaxial pulleys. The guide members 15, 17, around which the belts or other elements constituting the flexible member 13 are driven, may be motorized, or preferably only one is motorized and the other is idle. In a possible embodiment the guide member 15 is motorized while the guide member 17 is idle and driven into rotation by the continuous flexible member 13.

In one embodiment the upper conveying member 9 comprises a further flexible member 19; also this member 19 may consist of a series of parallel belts. The belts 19 are driven around the guide member 17 and around a further guide member 21.

In a possible embodiment coaxial pulleys 17 are provided, independent of one another and mounted idle on a common axis, while each of the two guide members 15 and 21 is formed from respective groups of pulleys keyed to a motorized shaft. In this way the flexible member 13 and the flexible member 19 may be moved independently of each other and making different movements in different times and at variable speeds independently of each other.

In a possible embodiment the lower surface 11 supporting the rolls comprises a first suction box 23 and a second suction box 25 arranged in series along the feeding path P of the rolls R. In one embodiment the suction box 23 has a substantially flat upper wall 23A with holes 23B through which air can be sucked. 23C indicates a duct for connection to a suction line.

In one embodiment the suction box 25 is delimited at the top by a substantially flat wall 23A with holes 25B through which the air is sucked. A duct 25C connects the inside of the suction box 25 to a suction line. The ducts 23C and 25C may be connected to the same suction line.

Along the substantially flat upper wall 23A of the suction box 23 extends the upper branch of a continuous flexible member 27, which may consist of a series of parallel belts or other. The flexible member 27 is driven around guide members 29, 31, 33, 37. These guide members, similar to the guide members 15, 17, and 21, may consist of rollers or groups of coaxial pulleys.

In one embodiment of the invention, the guide member 31, for instance a roller or a group of parallel coaxial pulleys keyed to a common shaft, is motorized, whilst the guide members 29, 33, and 37 are idle.

The upper branch of the flexible member 27 is indicated with 27A. This upper branch extends along the outer surface of the wall 23A of the suction box 23.

With an arrangement similar to that described with reference to the flexible member 27, a further flexible member 39 has an upper branch 39A sliding along the outer surface of the substantially flat upper wall 25A of the suction box 25. Like the flexible member 27, also the continuous flexible member 39 may consist of parallel belts or other, and is driven around the guide member 37 as well as around further guide members 41, 43, 45. Like the guide member 37, also the guide members 41, 43, 45 may be of various kind; they may be for example rollers or cylinders or even a group of coaxial pulleys.

Like the pulleys 17, also the pulleys 37 may be preferably mounted idle one independently of the other on a common shaft, to allow the flexible member 27 to move independently of the flexible member 39. This latter is moved by one of the other guide members, for instance the roller 41, which may be motorized.

In one embodiment, upstream of the suction box 23 there is a station for unwinding and positioning the tail end of the rolls to be glued. The unwinding and positioning station is indicated as a whole with number 46. This unwinding and positioning station 46 comprises an unwinding member 47. In one embodiment, the unwinding member 47 may comprise one or more belts in contact with the roll to be unwound. In a different embodiment, illustrated in the figure, the unwinding member 47 comprises a motorized roller 49 cooperating with the continuous flexible member 13 and spaced from the lower branch 13A thereof by a length equal to or slightly smaller than the diameter of the rolls R.

In one embodiment the upper conveying member 9 may be adjusted in height to modify the distance between the lower branch 13A of the flexible member 13 and the motorized roller 49, thus adapting the machine to the various diameters of the rolls R.

Between the roller 49 and the guide member 29 an opening, space or cavity is provided, extending below a geometrical surface formed by the extension of the substantially flat upper wall 23A of the suction box 23 and by a surface 51 tangent to the roller 49, see in particular FIG. 2.

In this opening, space or cavity, indicated with number 53 and extending transversally with respect to the feeding direction of the path P, a pressure member is housed for stabilizing a fold obtained as described below in an area or length of web material unwound from each roll R fed to the machine 1. In one embodiment this pressure member, indicated as a whole with number 55, comprises a series of oscillating levers or arms 57, articulated around a common axis 59 substantially transverse with respect to the feeding direction of the rolls R. 61 indicates an actuator, for instance a cylinder-piston actuator, controlling the oscillation of the arms 57 that may be joined by a common shaft 62, with which the actuator 61 is articulated. In one embodiment two or more actuators 61 are provided at the ends or at various points along the extension of the shaft 62 to apply a sufficient stress onto the arms 57. The arms 57 are levers that, with a moderate effort of the actuators 61, through their ends 57A exert a very high pressure against a pressure surface 63 formed for instance on a transverse block delimiting the transverse cavity or space 53 and defining the surface 51.

Below the pressure surface 63, with which the ends 57A of the arms 57 cooperate, there are suction holes 67 distributed preferably along the whole width of the machine, i.e. along the whole transverse extension of the cavity or space 53 below the surface 51. The ducts 67 are connected to a suction space or collector 68, so that, adjacent to the surface 63, a suction is obtained to hold a portion of web material between the pressure surface 63 and the ends 57A of the arms 57 for the purposes better explained below.

The action of said suction through the holes 67 may be replaced or combined with the action of pressurized air jets G generated by nozzles 68 positioned between the upper branch and the lower branch of the continuous flexible member 13. The nozzles 69 are directed towards the cavity defined between the pressure surface 63 and the ends 57A of the oscillating arms 57. Preferably more nozzles 69 are aligned transversally along all or part of the transverse extension of the machine.

In one embodiment, between the upper and lower branches of the continuous flexible member 13 there is a second series of pressurized air nozzles 71. These latter are connected to a pressurized air duct 73, similarly to the nozzles 69 that are connected to a pressurized air duct 75. In a modified embodiment the nozzles 71 and 69 may be connected to the same pressurized air duct. The nozzles 71 are inclined with respect to the lower branch 13A of the continuous flexible member 13 and more precisely they are inclined so that the air jets G2 that they generate are directed with a component in the feeding direction of the rolls R along the path P.

In one embodiment, there is also a sensor between the upper branch and the lower branch of the continuous flexible member 13; this sensor, for instance a photocell 77, is to detect the presence of a tail end L of web material N in a given position, for instance along the upper branch 27A of the continuous flexible member 27.

In one embodiment a further sensor 79, for instance an optical sensor, is arranged between the upper branch and the lower branch of the flexible member 19. The sensor 79 is arranged so as to read the presence of a tail end of web material nearly in correspondence of the guide member 45 of the continuous flexible member 39.

In one embodiment, downstream of the guide member 45 a cavity or space 81 is arranged (FIG. 4), extending below an ideal geometrical surface constituting the extension of the upper branch 39A of the continuous flexible member 39. The machine portion, where the space or cavity 81 is located, forms a station, indicated as a whole with number 82, for sealing the roll tail end. The cavity or space 81 is delimited upstream by a crossbar 83 that can be constrained for instance to a fixed structure or frame 85. Downstream of the crossbar 85 a chute 86 is provided. The chute 86 may be formed by a series of profiles that are aligned to one another transversely to the forward movement of the rolls or logs R through the machine. Between the crossbar 85 and the chute 86 an opening or slot 81A is defined. In the area of the opening 81A there are the devices for sealing the tail end of the roll. These devices comprise both mechanical ply-bonding systems and gluing systems, i.e. sealing systems wherein a glue is applied to the web material forming the roll.

The structure 85 is designed to be intercalated for instance between the parallel belts defining the continuous flexible member 39. The suction box 25 may be shaped to house a comb-shaped structure of the frame 85.

Figure 5:
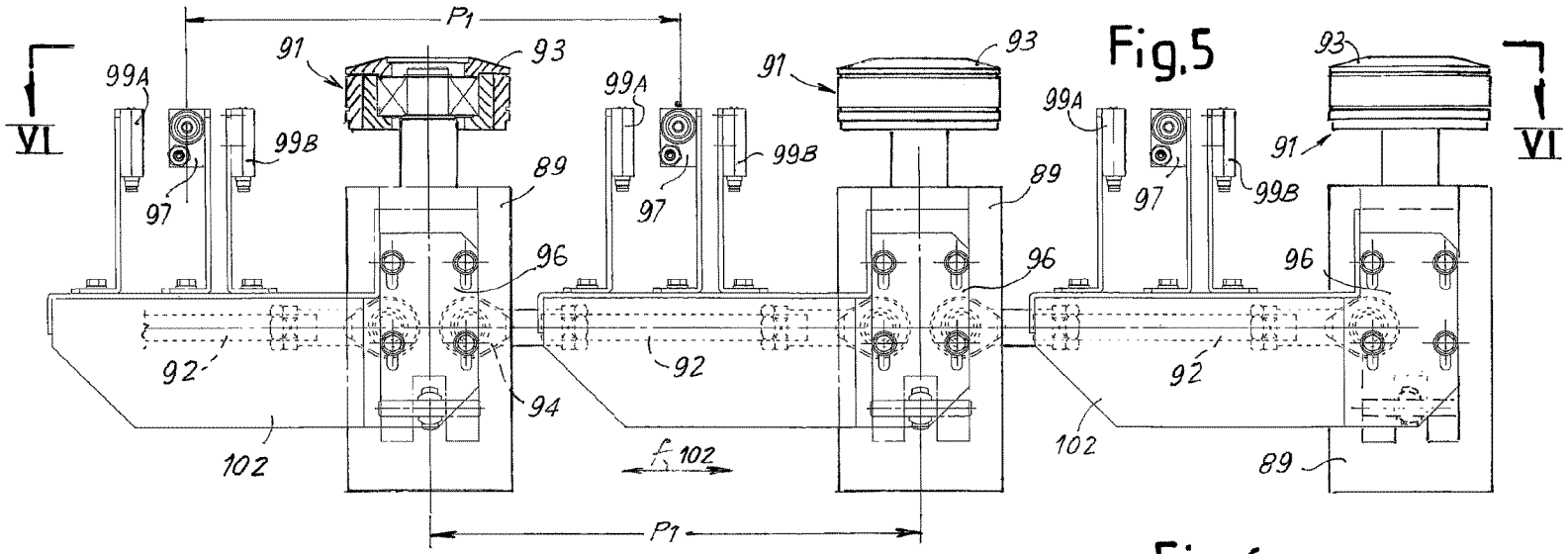
FIG. 5 shows a front view according to V-V of FIG. 4 of a series of slides carrying mechanical ply-bonding rollers.
Figure 6:
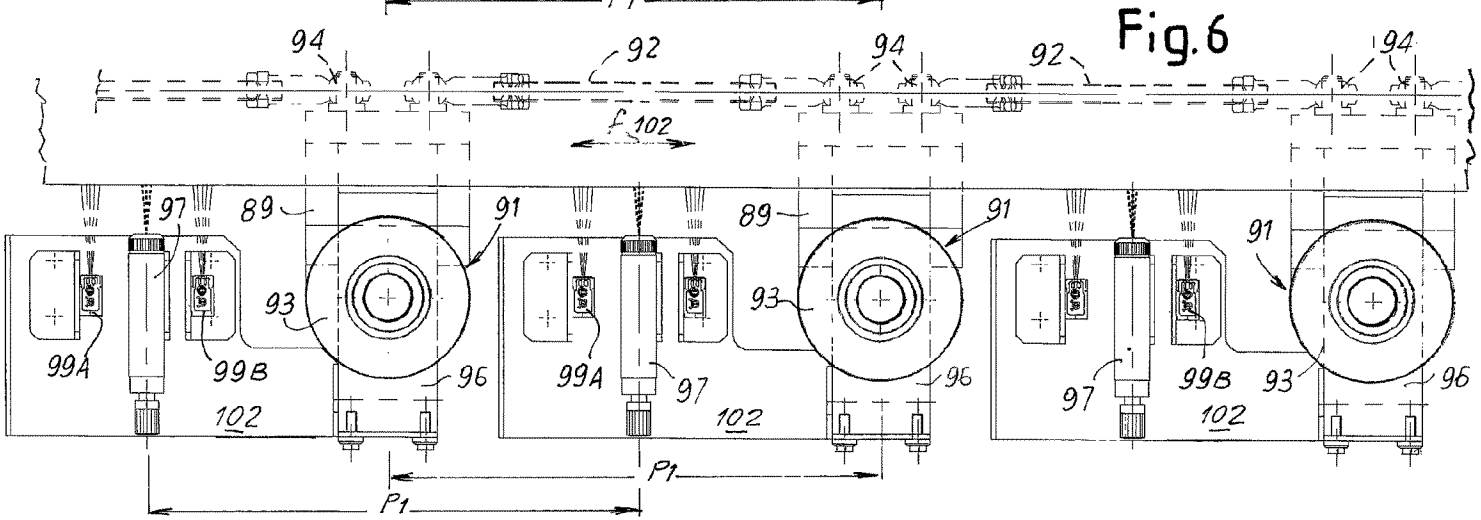
FIG. 6 shows a view according to VI-VI in FIG. 5.

In one embodiment, guides 87 are fixed to the bearing structure or frame 85; along these guides slides 89 slide, engaged to the guides 87 by means of shoes 90. Each slide 89 carries a mechanical ply-bonding roller 91. FIGS. 5 and 6 show a front view according to V-V of FIG. 4 and a plan view according to VI-VI of FIG. 5, respectively, of a part of the slides 89. The number of slides 89 may vary. As it will be better explained in the description of the machine operation, the greater the number of slides, and therefore of mechanical ply-bonding rollers 91, the higher the machine productivity, i.e. the number of logs or rolls per time unit that the machine can process.

Each mechanical ply-bonding roller 91 may have a preferably knurled annular edge 93, cooperating with the cross-bar 83 by pressing against it while the mechanical ply-bonding roller 91 moves along the guides 87 by means of the slide 89. The slides 89 may be joined together by means of tie-rods 92 (see in particular FIGS. 5 and 6). The tie rods 92 may be fixed at the two opposite ends by means of spherical joints 94. In this way a single actuator is sufficient, for instance a cylinder-piston actuator (not shown) on one side of the machine, to move simultaneously all the slides 89 and therefore all the mechanical ply-bonding rollers 91.

Each mechanical ply-bonding roller 91 is fixed to the respective slide 89 through a support bracket 96 articulated with the slide 89 around an axis 96A. The oscillation movement of the support bracket 96 around the axis 96A brings the mechanical ply-bonding roller 91 in a working position or an idle position, alternatively, as it will be better explained below with reference to two operating modes of the machine. The movement of rotation around the axis 96A is imparted to each support bracket 96 by an actuator, for instance an air spring, or a preferably pneumatic cylinder-piston actuator. In the drawing, 98 indicates respective cylinder-piston actuators of each mechanical ply-bonding roller 91. Each cylinder-piston actuator 98 is articulated at 98A with the respective slide 89 and at 98B with the respective support bracket 96 carrying the corresponding mechanical ply-bonding roller 91. The oscillation or rotation movement of the brackets 96 around the axis 96A may be transmitted to the chute 86 through rods for connecting the brackets 96 (or some of them) and the chute 86 so that this latter does not interfere with the transverse movement of the mechanical ply-bonding rollers 91.

In the illustrated embodiment, in addition to the respective mechanical ply-bonding roller 91, each slide 89 carries a glue dispensing nozzle 97 mounted for instance on a shelf 102. In the illustrated example the shelf 102 is fixed to the support bracket 96 and therefore each glue dispensing nozzle is moved angularly together with the respective mechanical ply-bonding roller. In other embodiments, not shown, the glue dispensing nozzle 97 may be mounted fixed with respect to the corresponding slide 89.

In advantageous embodiments, to each glue dispensing nozzle 97 at least one sensor is associated to detect whether there is web material to be glued, according to the methods described in greater detail below with reference to one of the operating modes of the machine. As shown in particular in FIGS. 5 and 6, with each glue dispensing nozzle 97 two sensors are preferably associated, indicated with 99A and 99B and arranged at the sides of the glue dispensing nozzle 97. The sensors 99A, 99B may be for instance optical sensors.

Figure 8:
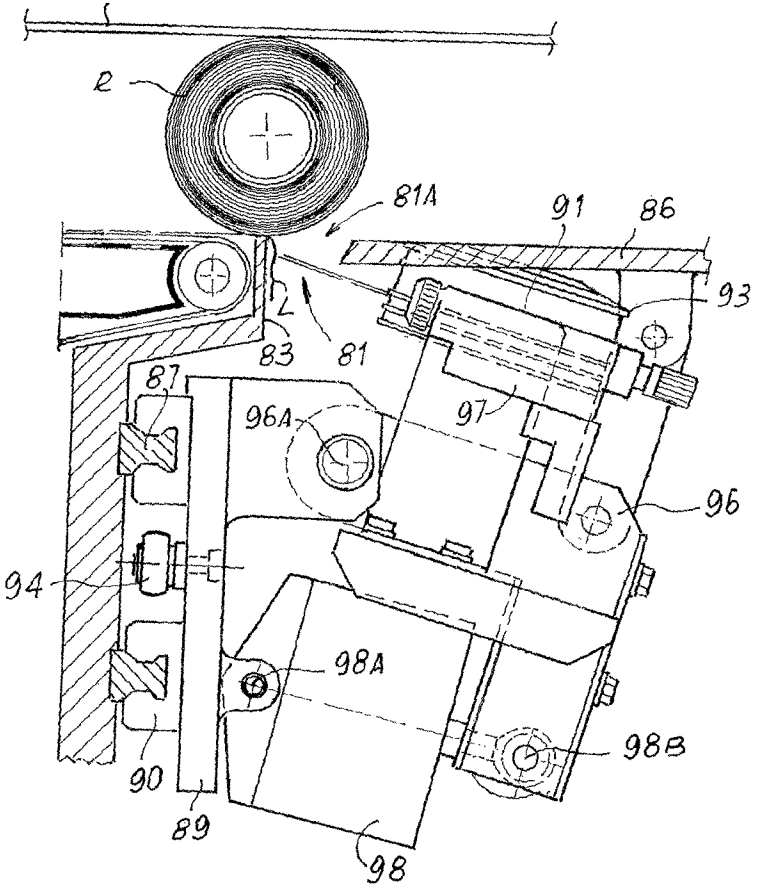
FIGS. 7 and 8 show a side view of a glue dispensing nozzle in two alternative operating positions.
Figure 7:
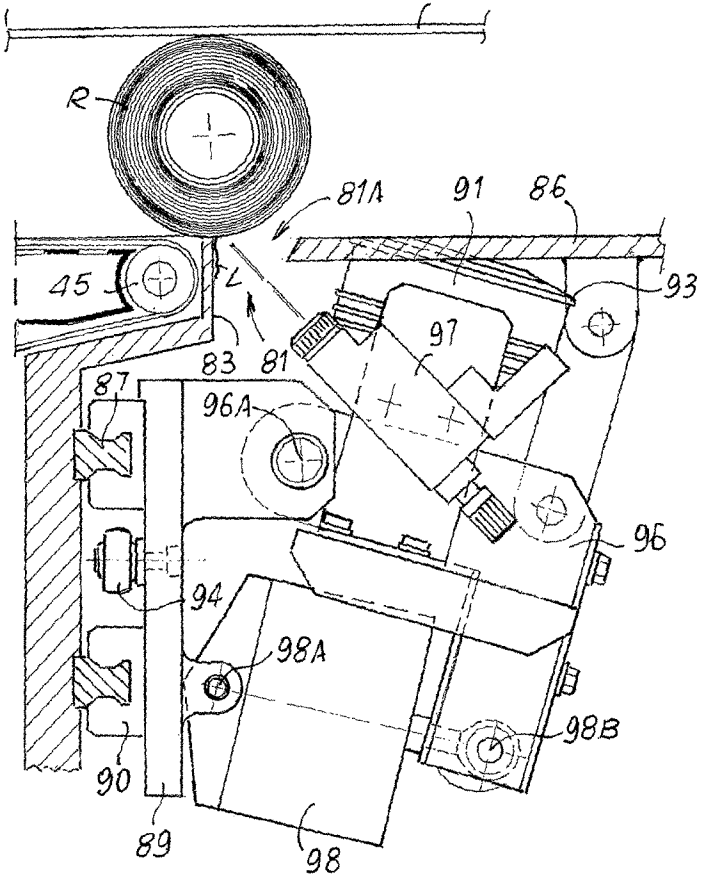

As it is clearly apparent from FIGS. 7 and 8, showing an enlarged side view of one of the slides 89 with the respective glue dispensing nozzle 97, this latter may be mounted on the shelf 102 in two different alternative positions, so as to be directed upwards to spray the glue directly onto a roll or log R through the opening or slot 81A (FIG. 7) or onto a tail end of a roll or log arranged above the slot 81A (FIG. 8). In some embodiments each glue dispensing nozzle 97 may be associated with a servo-mechanism or an actuator to automatically switch between the position of FIG. 7 to that of FIG. 8, allowing the machine to operate alternatively in one or the other of the two gluing modes.

Below the space or cavity 81 a suction system may be provided, not shown, that (to the purposes described below), generates an air flow sucking below the rolling surface of the rolls R the tail end L of the roll R and the intermediate transverse fold, if any, created along the outermost turn of the wound web material when the machine operates without glue application. In combination with or instead of the suction system a series of pressurized air nozzles 101 may be provided, pushing the tail end L and, if necessary, the fold F below the rolling surface R.

As mentioned, the machine may operate in at least two different modes to close the tail end L of each roll or log R fed to the machine. In a first operating mode sealing is performed by mechanical bonding the tail end L to a portion of web material of the last turn, forming a fold projecting from the cylindrical side surface of the roll. In a second operating mode the tail end L is closed by gluing it. In this second case, as mentioned, in a particularly advantageous embodiment of the machine the glue may be applied on the tail end L or on the cylindrical side surface of the roll or log R. The machine may be designed to apply glue only in one of the two positions. The machine is preferably configured to apply the glue alternatively in one way or the other. When the machine operates with glue application, the fold of the web material is not formed.

With reference to the sequence of FIGS. 9A-9J, the operating mode without glue will be now described.

Figure 9A:
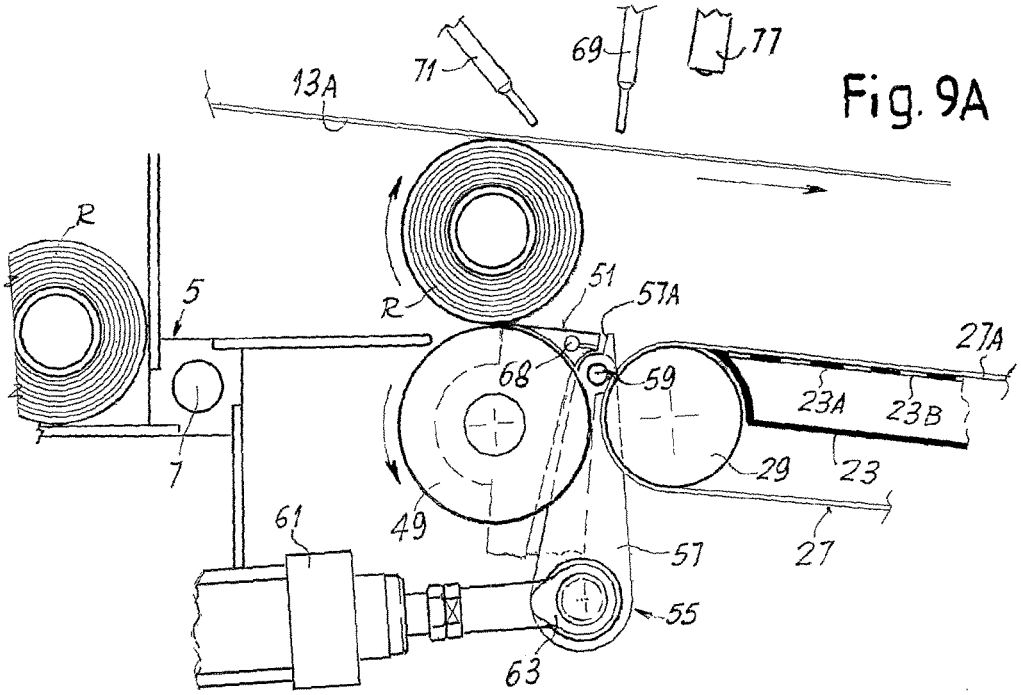
FIGS. 9A-9J show an operating sequence of the machine in a first operating mode.
Figure 9B:
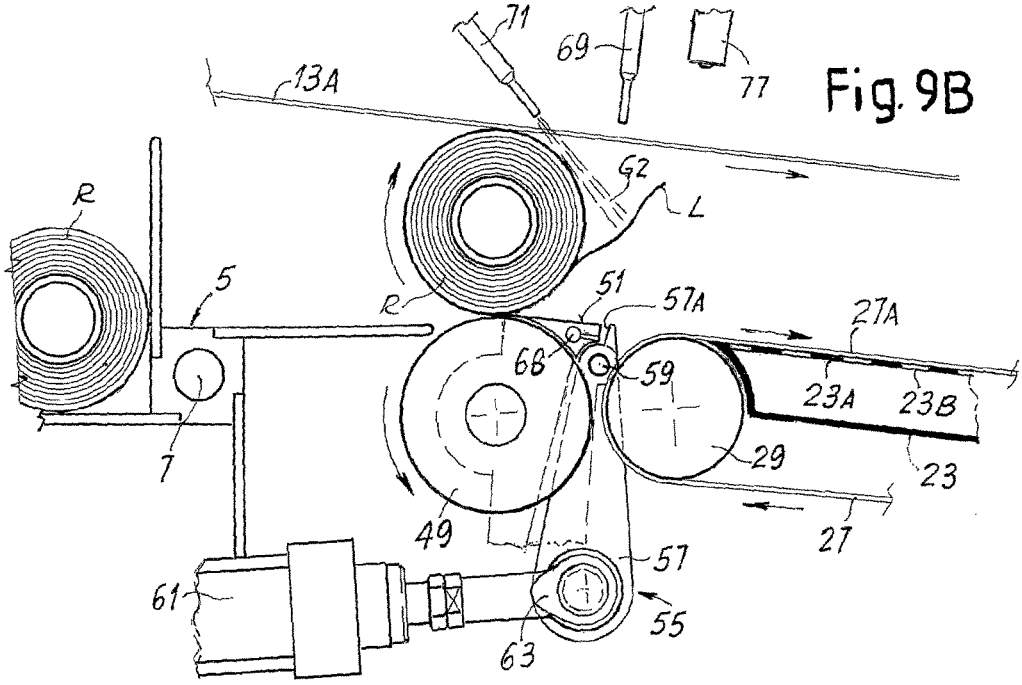
Figure 9C:
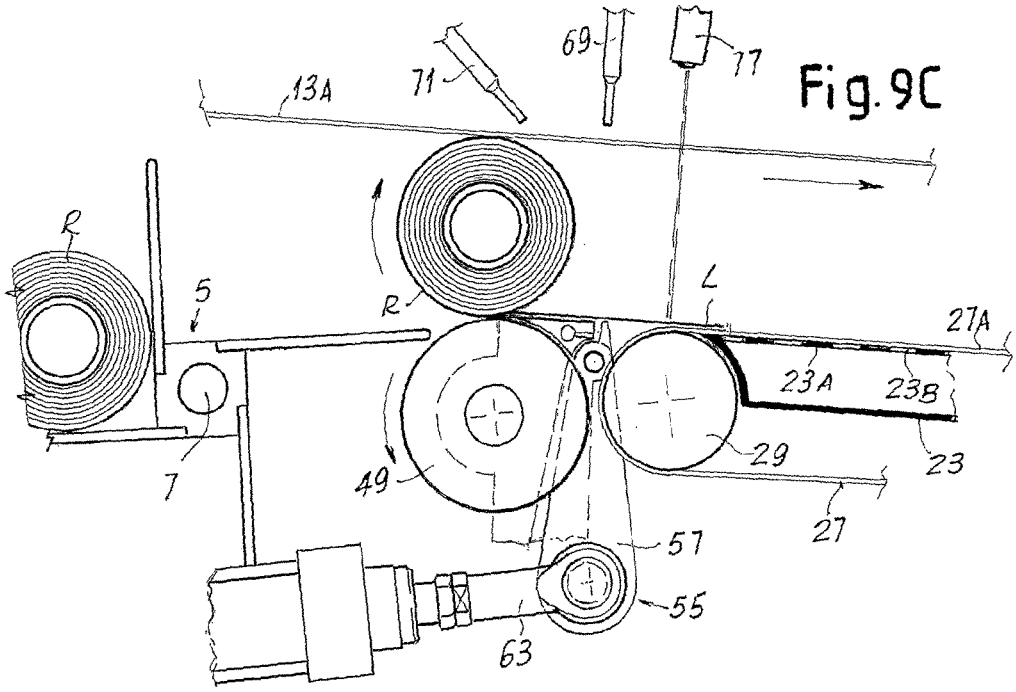
Figure 9D:
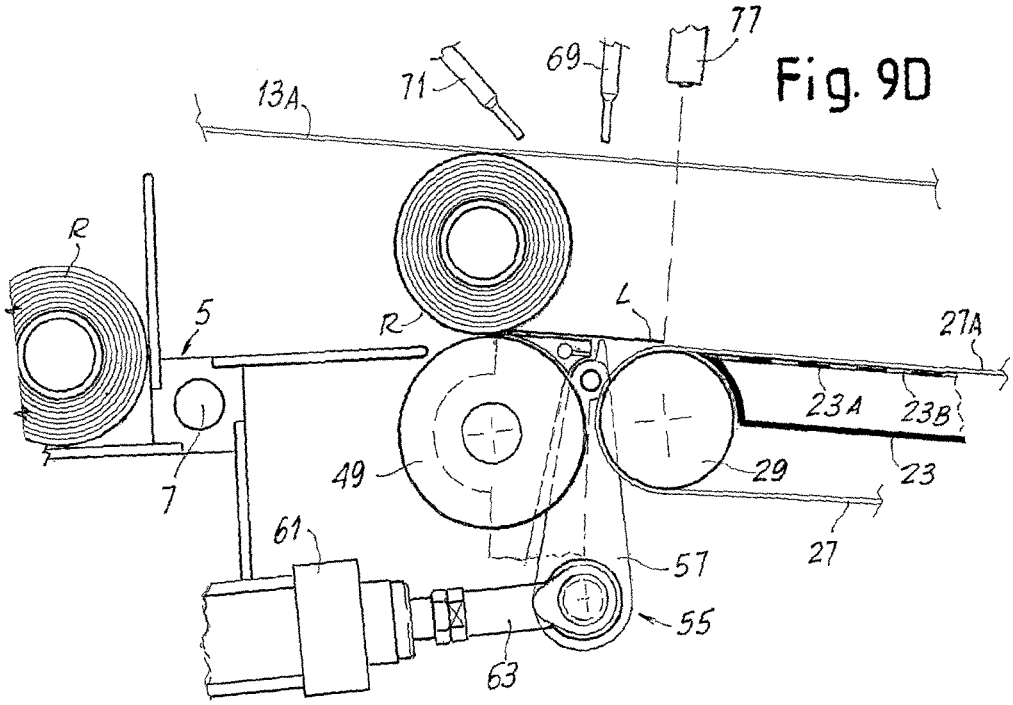
Figure 9E:
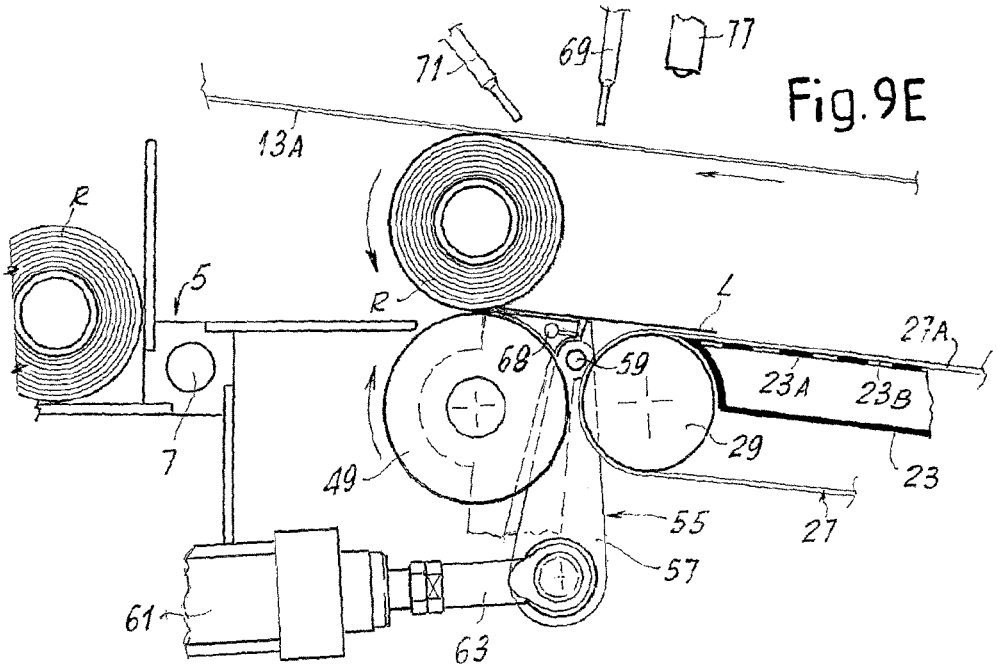

Firstly, the rotating dispenser 5 picks up from the chute 3 a roll R coming from an upstream machine; the roll is then inserted between the lower motorized roller 49 and the lower branch 13A of the flexible member 13. The members 49 and 13 move at substantially equal peripheral speed and in such a direction that the roll R rotates in winding direction (FIG. 9A). At the point of contact of the roller 49 and the lower branch 13A of the flexible member 13 with the roll R the speed is the same and the direction is discordant; the axis of the roll R remains therefore in a substantially fixed position while the roll R rotates around it.

The nozzles 71 generate air jets G2; when the tail end L is in the area of action of said air jets G2 (FIG. 9B) it is thus unwound and stretched on the rolling surface below, defined by the upper branch 27A of the continuous flexible member 27 and by the upper wall 23A of the suction box 23 along which the upper branch 27A of the continuous flexible member 27 extends. A segment of web material wound on the roll R is thus unwound and stretched below the sensor 77, see FIG. 9C.

Figure 9F:
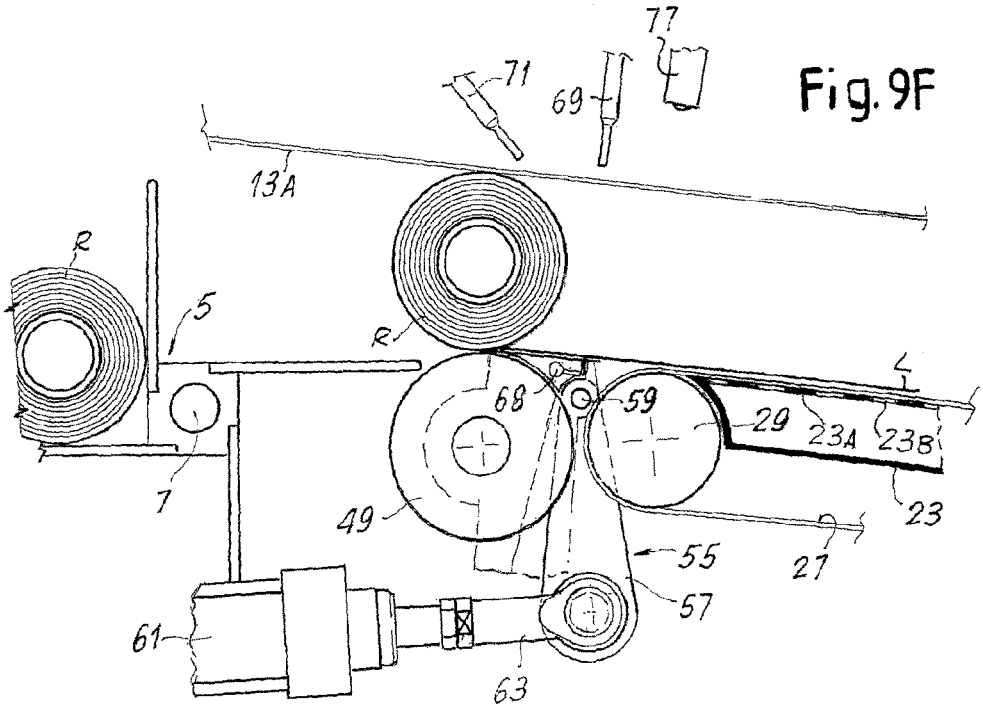

Continuing the movement of rotation of the motorized roller 49 and the movement of the upper flexible member 13 the web material N is gradually rewound on the roll R. As the tail end L is detected by the sensor 77 (FIG. 9D) this latter generates a signal sent to a central control unit 100 (FIG. 1), with which are connected and by which are controlled the various motors of the machine. Upon this signal, the movement of the motorized roller 49 and of the upper flexible member 13 is inverted, so that these two members move again at equal speed, but such that the roll R rotates around its own (substantially fixed) axis in opposite direction to cause unwinding of the web material. In this step also the lower flexible member 27 moves in the direction indicated in FIGS. 9A, 9B, so that a given length of web material is unwound from the roll R and stretched on the unwinding surface defined by the upper branch 27A of the lower flexible member 27 and by the upper wall 23A of the suction box 23. This unwinding step is stopped when an adequate length of web material has been unwound, slightly greater than the circumference of the roll R (FIG. 9F). This length may be determined through a further optical sensor that is similar to the sensor 77 and may be suitably arranged between the branches of the upper flexible member 13 along the path of the roll R. In another embodiment (not shown) the length of the unwound web material is controlled based upon time, i.e. the movement of the roller 49 of the upper flexible member 13 as well as of the lower flexible member 27 are maintained for a time that, multiplied by the unwinding speed of the roll R, gives the required unwound length. The length may be also controlled through an encoder associated with one of the movable members 49, 13, 27. The signal of the optical sensor 77 is the starting point of the measurement carried out by the encoder or other position sensor.

Once the desired length of web material has been unwound, the members 49 and 13 stop; the pneumatic system constituted by the suction through the ducts 67 and/or the air jets through the nozzles 69 is then actuated to generate a fold F of web material below the surface 51, forming two transverse portions of web material arranged between the pressure surface 63 and the ends 57A of the oscillating arms 57. The fold F is formed at a distance from the tail end of the web material that is slightly greater than the circumference of the roll or log R, so that the tail end L can be mechanically anchored to the fold F, as described in greater detail below, once the previously unwound portion of web material has been rewound around the roll.

The suction and/or the air jets through the nozzles 69 may be maintained for all the time necessary to generate and stabilize the transverse fold F in the web material N. The fold is stabilized by actuating the oscillation of the arms 57 through the actuators 61 so that the ends 57A of the arms 57 press with high localized pressure against the pressure surface 63. The two opposite portions of web material defining the fold F are thus joined by means of the mechanical effect of the high localized pressure exerted by the ends 57A of the arms 57. This operation stabilizes the fold.

Practically, the fold F is formed by two strips or portions of web material moved towards and joined to each other, defined by three folding lines parallel to one another and to the axis of the roll R.

In a modified embodiment the two strips or portions of web material defining the fold F may be bonded together by means of one or more mechanical ply-bonding rollers similar to the mechanical ply-bonding rollers 91 described above. In a modified embodiment mechanical bonding of the two opposite strips defining the fold F may occur by means of tips, needles, projections or the like, perforating the two strips. These members are suitably shaped so as to cause, by entering and/or exiting the web material, such a breakage of this web material to obtain a localized bonding due to the tearing, perforation or other mechanical action on the web material N subjected to the mechanical action.

Figure 9G:
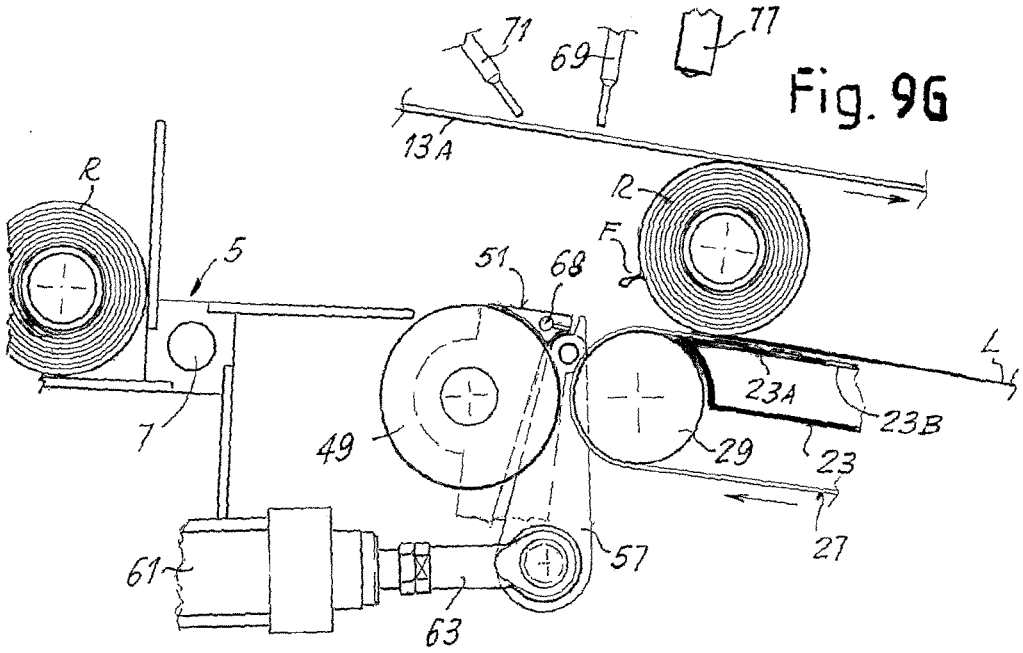

When this operation is finished, the transverse fold F generated in the web material N unwound from the roll R is suitably stabilized, so that the subsequent rewinding will occur by maintaining a strip folded and projecting from the last turn of the web material, as shown in FIG. 9G.

In the subsequent step the roll R is moved forwards along the path P between the lower branch 13A of the upper member 13 and the suction box 23 as well as the upper branch 27A of the lower continuous flexible member 27 thanks to the movement of the flexible member 13 and of the lower continuous flexible member 27, while the roller 49 may be stopped, slowed down or rotated in opposite direction. The lower flexible member 27 may remain fixed, but it is preferably movable to facilitate the forwards movement of the roll R along the path P with a movement of translation and rolling on the lower unwinding surface defined by the branch 27A of the lower flexible member 27.

Figure 9H:
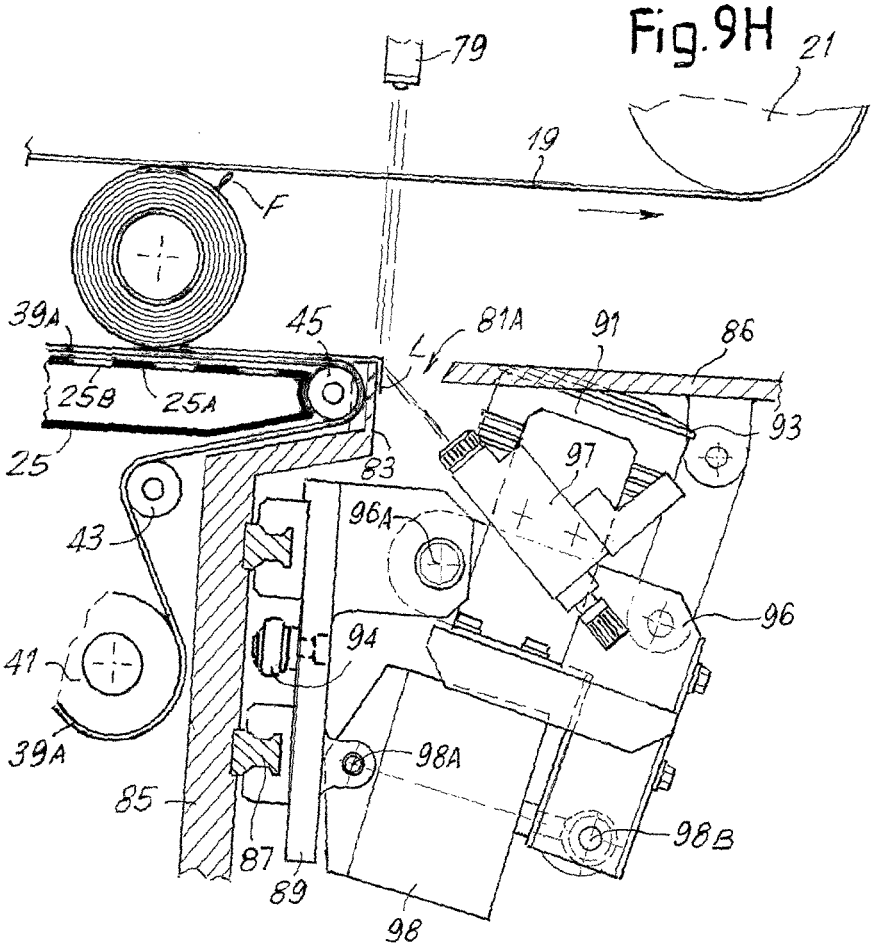

By modulating the speed of the continuous flexible upper member 13 and of the continuous flexible lower member 27 it is possible to move the roll R forward and to gradually wind it, but still maintaining a segment of web material unwound between the roll and the tail end L thereof. In this way, continuing advancing, the roll R is positioned above the suction box 25 between this latter and the upper flexible member 19 with the tail end L arranged nearly in correspondence of the space 81, i.e. in correspondence or slightly downstream of the upper corner of the crossbar 83, as shown in FIG. 9H. This position is detected through the optical sensor 79. To achieve this position, the forward movement of the roll along the path P is obtained not only through the movement of the upper flexible member 13 and of the lower flexible member 27, but also through the movement of the upper flexible member 19 in combination with the movement of the lower flexible member 39 along the suction box 25.

As shown in FIG. 9H, when this forward movement is finished, controlled by means of the sensor 79, the roll R is near the crossbar 83 with the tail end L below the rolling surface defined by the upper branch 39A of the lower flexible member 39. The tail end L is sucked downwards by means of the suction in this area generated by the suction member (not shown) and/or by the air jets of the nozzles 101.

Once this position has been achieved, the lower flexible member 39A stops and the roll R continues to move forwards by rolling on the fixed upper branch 39A of the continuous flexible member 39 due to the effect of continuous movement of the upper flexible member 19, until the fold F previously formed and stabilized by means of the member 57 is positioned adjacent to the tail end L that in the meantime has been sucked or pushed by the jets of the nozzles 101 inside the space 81 against the crossbar 83.

Figure 9I:
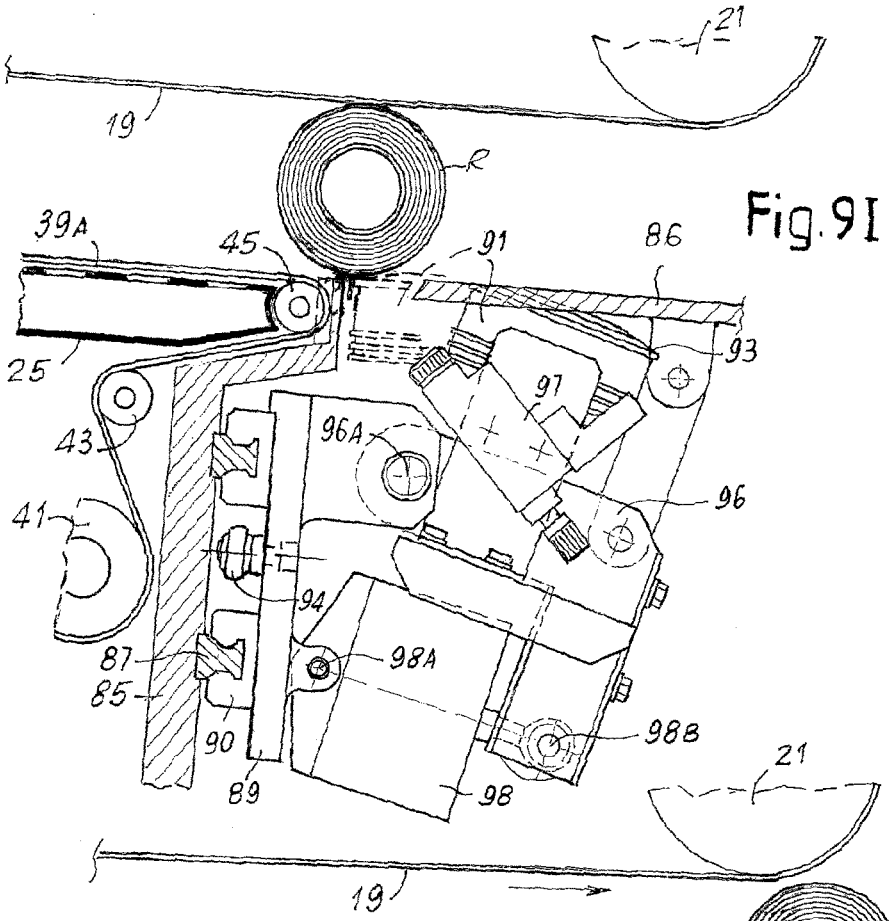

FIG. 9I shows the final arrangement of the roll R with the tail end L and the fold F in the space 81 adjacent to the crossbar 83.

Once this position has been achieved, the tail end L is actually sealed through mechanical joining or mechanical ply-bonding by means of the mechanical ply-bonding rollers 91.

To this end, the actuators 98 control oscillation of the mechanical ply-bonding rollers 91, so as to press with their annular edges 93 against the crossbar 83. The slides 89 are simultaneously translated parallel to the axis of the roll R. As more mechanical ply-bonding rollers 91 are advantageously provided, the stroke of the slides 89 according to the arrow f89 (FIGS. 5 and 6) may be nearly equal to the pitch between the mechanical ply-bonding rollers 91, indicated with P1 in FIGS. 5 and 6. In some cases the stroke may be slightly greater than the pitch P1, to take into account that during the step of moving the mechanical ply-bonding rollers 91 towards the crossbar 83 the pressure exerted by the mechanical ply-bonding rollers 91 may be not sufficient to correctly mechanically bond the three layers of web material together, forming the fold F (the first two layers) and the tail end L (the third layer).

The mechanical ply-bonding rollers 91 are advantageously mounted idle on their support shaft and roll on the crossbar 83, pressing the three layers of web material forming the fold F and the tail end L against one another. A particularly effective mechanical bonding is obtained if the annular edge 93 of the mechanical ply-bonding rollers is knurled, i.e. provided with a surface engraving, reducing the contact surface between mechanical ply-bonding roller and web material.

The high pressure exerted by the annular edge 93 of the mechanical ply-bonding roller against the pressure surface defined by the crossbar 83 causes the mechanical joining of the tail end L on the fold F. Substantially, the cellulose fibers of the three layers of web material forming the tail end L and the fold F locally fuse, at the points of greater pressure, thus closing the roll R.

In other embodiments the mechanical bonding between tail end L and fold F may occur not through localized pressure but rather through adequately shaped perforating members, for instance needles or tips similar to those used for mechanical entanglement. These members may be carried by idle rollers similar to the mechanical ply-bonding rollers 91.

Figure 9J:
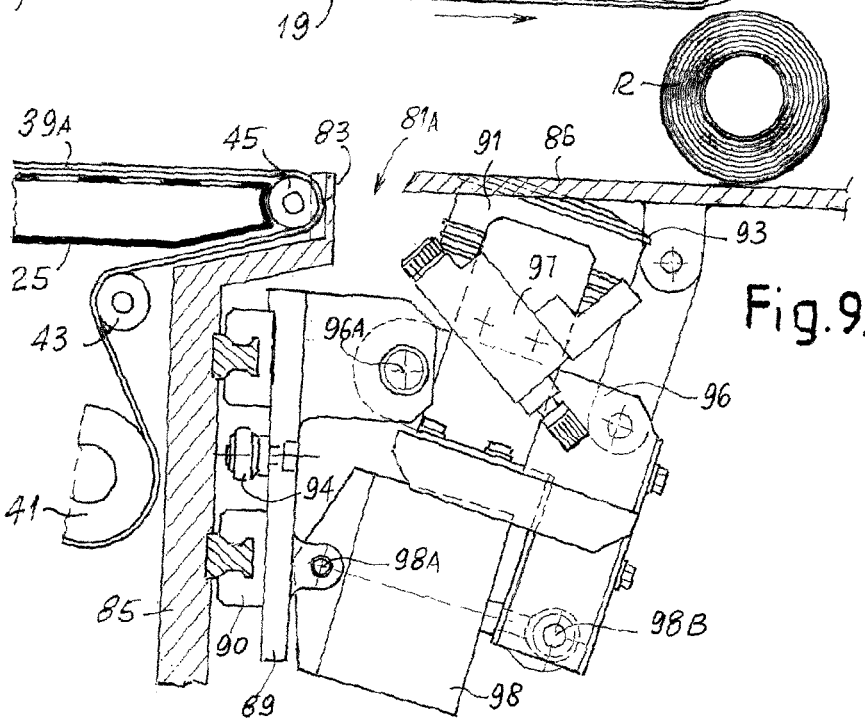

The roll R with the tail end L mechanically anchored to the fold F is then discharged from the machine along the exit chute 86 through the continuous flexible member 19 that, once mechanical bonding of the tail end has been performed, is driven into movement to control the rolling and the discharge of the closed roll R (FIG. 9J).

In this operating mode, the glue dispensing nozzles 97 are idle.

The transverse movement of the slides 89 may be performed alternately in one direction and in the opposite direction, so as to reduce times and movements performed by the machine.

Figure 10A:
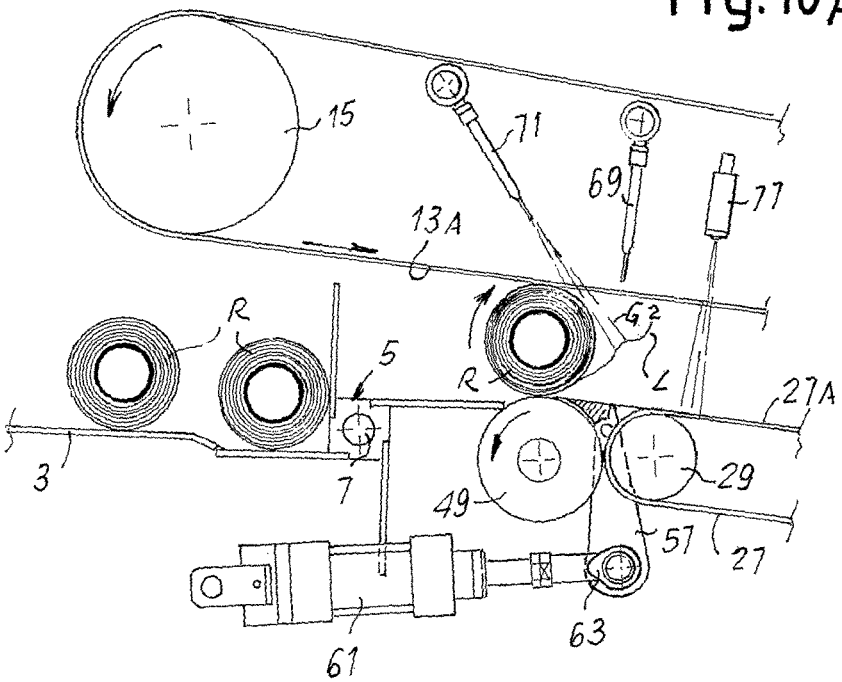
FIGS. 10A-10E show an operating sequence of the machine in a second operating mode.
Figure 10B:
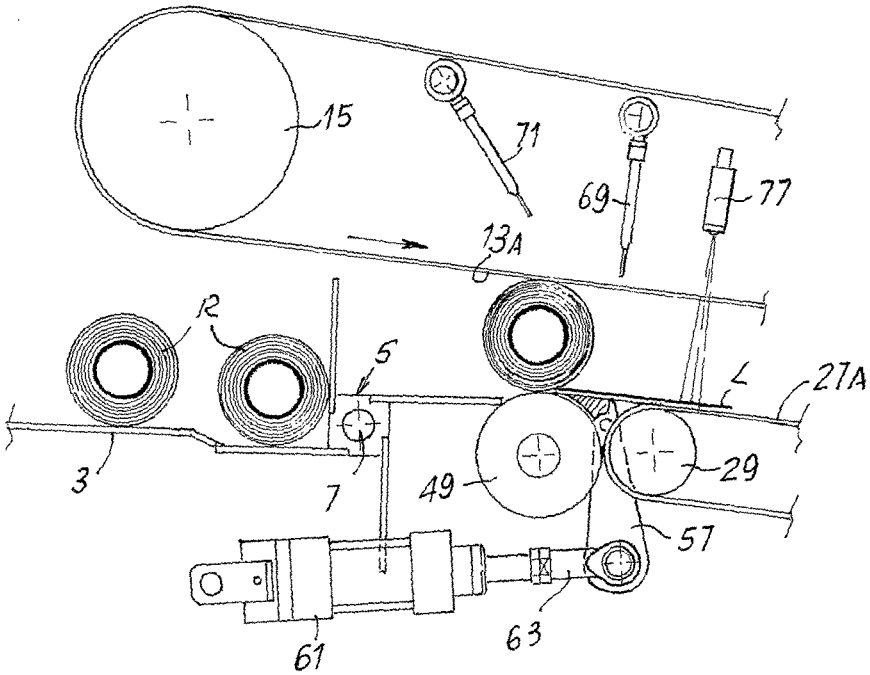
Figure 10C:
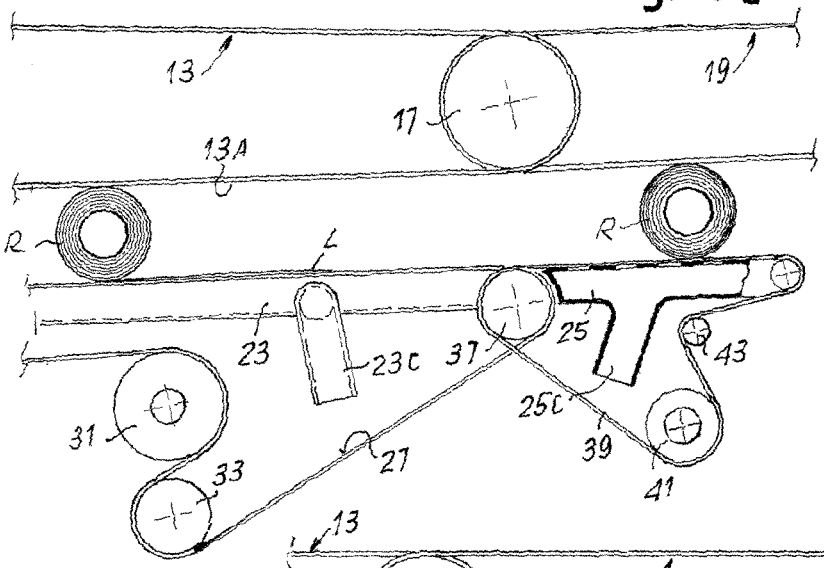
Figure 10D:
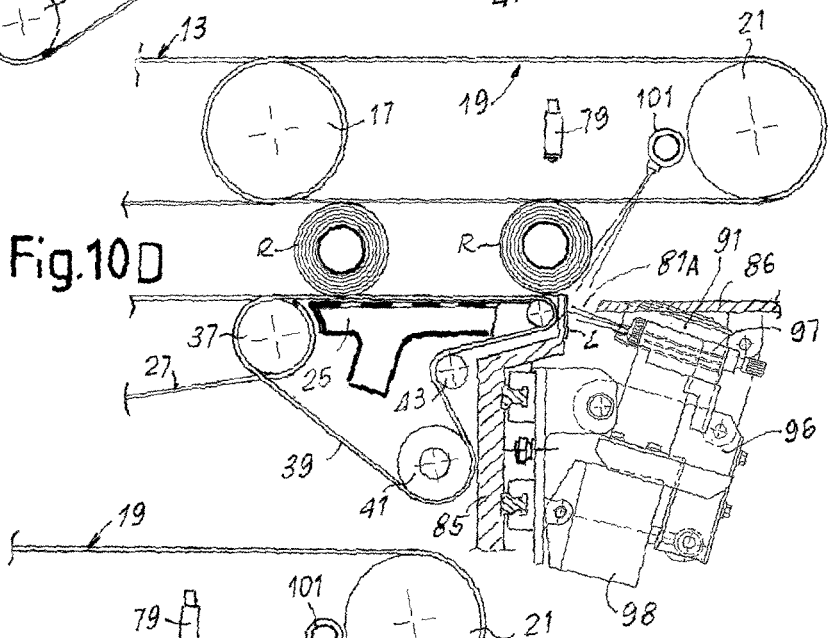
Figure 10E:
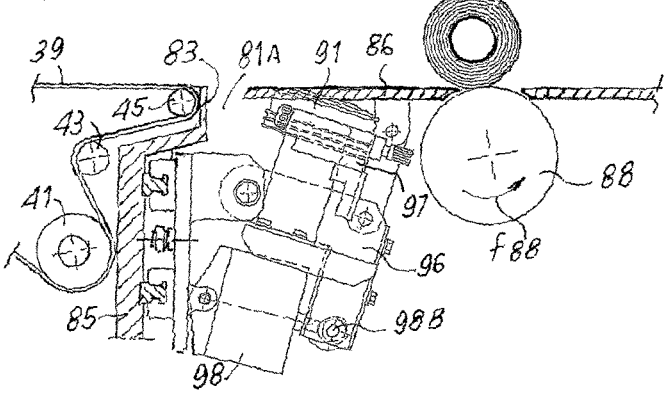

When the tail end L must be sealed by gluing and not by mechanical bonding, the mechanical ply-bonding rollers 91 remain idle, i.e. in the position illustrated in FIGS. 7 and 8, while the glue dispensing nozzles 97 are actuated. The functioning cycle in this case is simpler and schematically illustrated in the sequence of FIGS. 10A-10E. The mechanism generating the fold F (pressure member 55 and associated pneumatic members) remains idle. The roll R is inserted in the machine (FIG. 10A) and the tail end L thereof is unwound and brought into a defined position (FIG. 10B) according to methods known to those skilled in the art. The roll is then moved forwards until the position of FIG. 10D, with the tail end L inserted in the cavity or space 81, where it is held stretched through suction generated by the sucking member and/or air jets generated by the nozzles 101.

The glue dispensing nozzles 97 are actuated to spray a dose of glue on the web material. In the example illustrated in the sequence of FIGS. 10A-10E the position of the glue dispensing nozzles 97 is such that the glue is sprayed on the tail end L and more in particular on the surface thereof that subsequently, during rewinding of the tail end L, will be brought into contact with the cylindrical surface of the roll R.

In contrast, arranging the glue dispensing nozzles 97 as shown in FIG. 7, the glue will be sprayed on the outer surface of the roll R, in an area that will be subsequently covered by the tail end L, when this latter will be rewound.

The glue dispensing nozzles 97 are translated according to the arrow f89 by moving the slides 89 carrying them, similarly to what occurs in the case of mechanical ply-bonding with mechanical ply-bonding rollers 91. The transverse translation is performed for a stroke that may be limited to the pitch P1 between the glue dispensing nozzles 97. In this way a continuous line of glue is applied.

It is also possible to apply glue in a different way, for instance by maintaining the glue dispensing nozzles 97 fixed, or moving them according to the arrow f89, but making them dispense in an intermittent way during displacement, so as to apply the glue in segments. In other operating modes, the transverse stroke according to f89 may be less than the pitch P1, so that, even if applying the glue continuously, it will be applied in segments.

Once the glue has been applied, the roll R is moved towards and along the exit chute 86, along which there is a roller 88 forming, together with the guide member 21, a nip through which the roll R passes. In a known manner, the speed of the roller 88 may be controlled so as to make the roll R rotate around its own axis performing one or more revolutions to press the tail end L against the outer surface of the roll R, thus stabilizing gluing.

If the tail end L is not correctly positioned, for instance as it is folded and not stretched, or it has defects, such as tears, holes or the like, to avoid that the glue dirties the machine, the glue application is stopped in correspondence of the areas where there is no web material to be glued in front of the glue dispensing nozzle 97. The sensors 99A, 99B at the two sides of each glue dispensing nozzle 97 allow to verify the presence of web material at every point of the trajectory of the glue dispensing nozzle 97, independently of the direction in which the glue dispensing nozzle 97 is moving, so that the control unit 100 has sufficient time to inhibit the glue application when no web material is detected.

Figure 11:
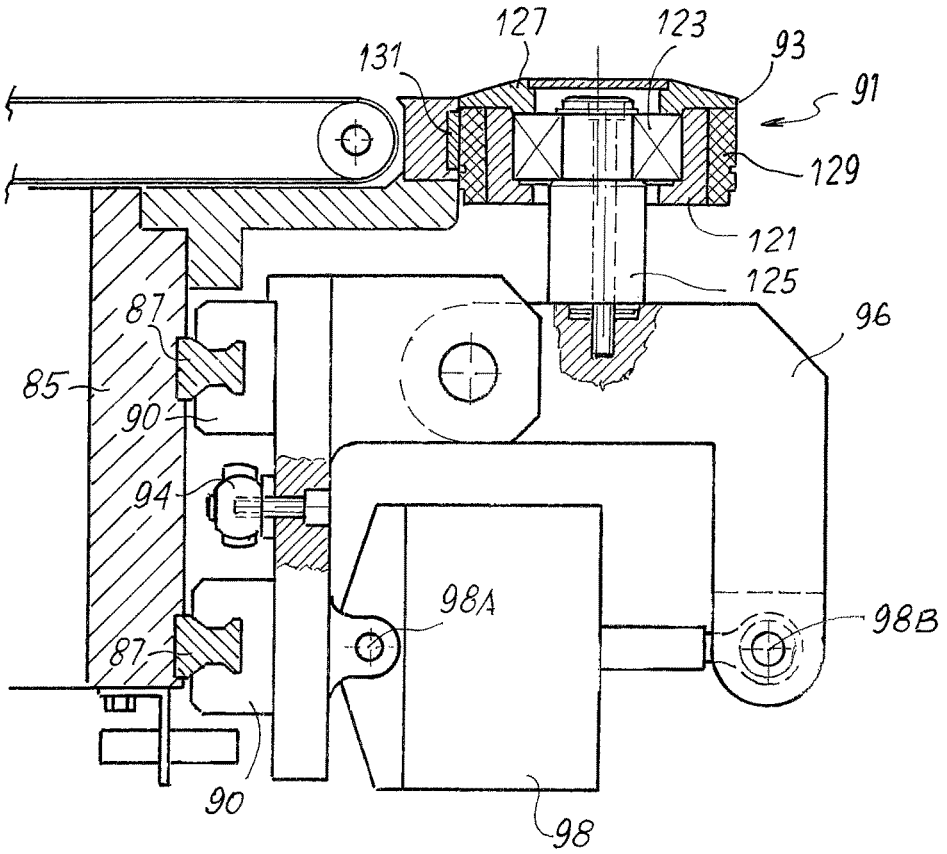
FIG. 11 shows a longitudinal section of a mechanical ply-bonding roller in an improved embodiment.

In some embodiments the mechanical ply-bonding rollers 91 may be designed so as to emboss the tail end L and the fold F of the roll R, for instance to print a logo, a writing or a decorative embossing pattern. FIG. 11 shows a longitudinal cross-section of a mechanical ply-bonding roller 91 designed to carry out this kind of treatment. Equal numbers indicate equal or equivalent parts to those of the embodiment described with reference to the previous figures. For instance, the mechanical ply-bonding roller 91 may have a cylindrical body 121 supported idle through a bearing 123 on a shaft 125 mounted on the support bracket 96. On the body 121 a disc-shaped element 127 is applied, forming the knurled annular edge 93.

Around the cylindrical body 121 a ring 129 is applied, made of elastically yielding material, for instance synthetic rubber, forming a preferably smooth and substantially cylindrical outer surface. This elastically yielding ring 129 cooperates with a bar 131 housed in a seat obtained in the crossbar 83. The bar 131 has for instance an engraved flat surface, facing the mechanical ply-bonding rollers 91. The engraving is the reverse logo, writing, drawing or other embossing pattern to be generated in the tail end L of the roll during mechanical ply-bonding. When the mechanical ply-bonding roller 91 rolls on the engraved flat surface of the bar 131, the web material is embossed between the engraved surface of the bar 131 and the elastically yielding material of the ring 129, so as to print the embossing pattern on the web material. The bar 131 is advantageously interchangeable so that it is easy to modify the embossing pattern.

Figure 12:
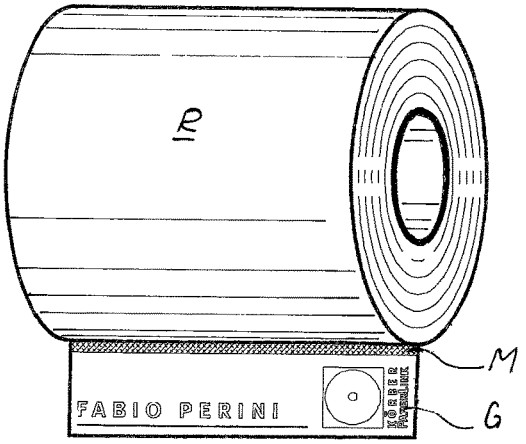
FIG. 12 shows a schematic view of a roll closed without glue.
Figure 13:
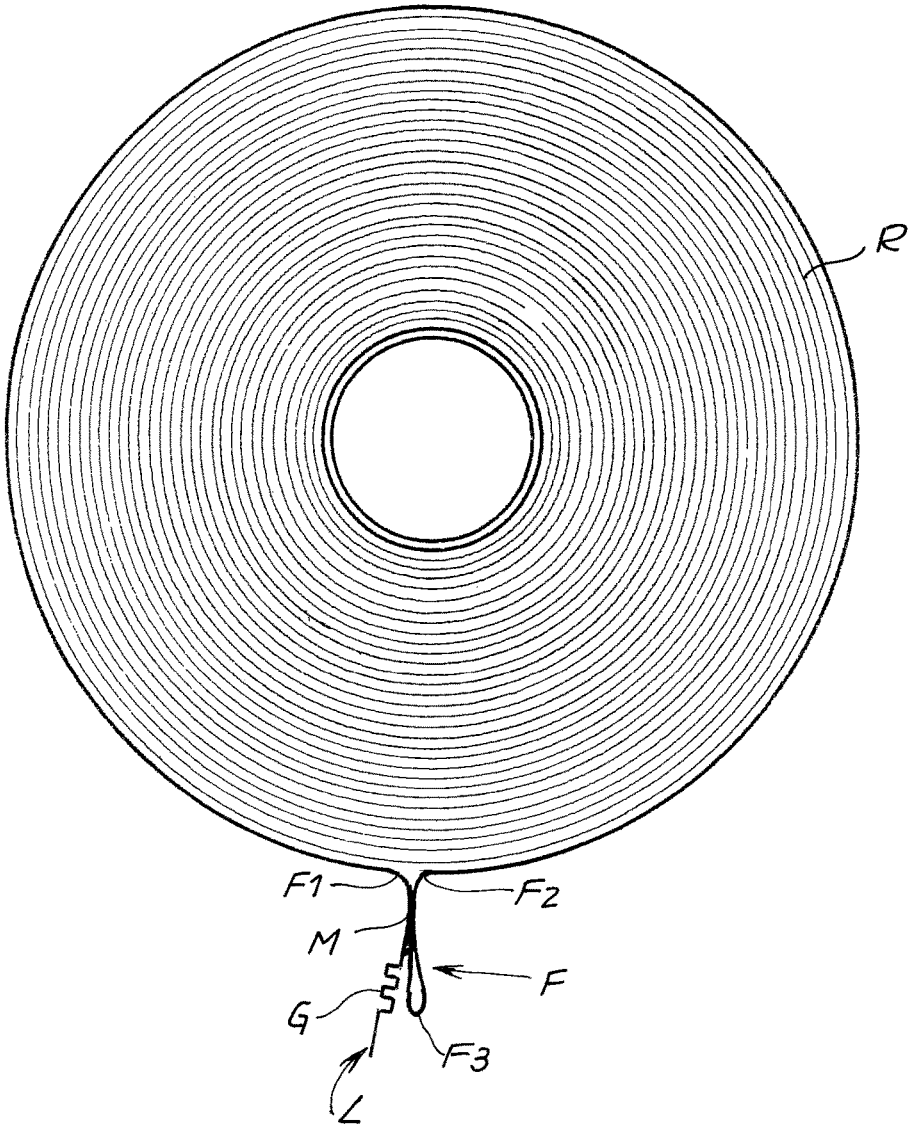
FIG. 13 shows a side view according to XIII-XIII in FIG. 12.

FIGS. 12 and 13 schematically show the result of an operation of mechanical sealing the tail end L of a roll R through mechanical ply-bonding rollers of the type illustrated in FIG. 11. FIG. 12 shows a portion of a roll or log, i.e. a small roll obtained by cutting a roll or log of greater axial length sealed by means of the machine described above. M indicates a mechanical ply-bonding line, and G indicates the embossed area of the web material. F indicates the fold to which the tail end L of the roll R is anchored. F1, F2, and F3 indicate three folding lines forming the fold F of web material, to which the tail end F is ply-bonded. In this exemplary embodiment, the tail end L projects radially beyond the fold F, but this is not strictly necessary.

While particular embodiments of the invention have been described above with reference to the attached drawings, those skilled in the art will understand the modifications, changes and omissions are possible without however departing from the innovative learning, the principles and the concepts described above. Therefore, the scope of the invention described shall be determined only based upon the widest interpretation of the attached claims, so as to understand all the modifications, changes and omissions. Furthermore, the order or sequence of any step of method or process may be changed according to alternative embodiments. Any reference numerals in the appended claims are provided to facilitate reading of the claims with reference to the description and to the drawing, and do not limit the scope of protection represented by the claims. The terms "comprising" "to comprise" and the like do not exclude the presence of further elements or steps in addition to those listed in a claim. The term "a" or "an" before an element or feature does not exclude the presence of a plurality of these elements or features. The term "means" used many times in a claim does not exclude the possibility that two or more of these means are actuated through a single element or component. The fact that given features, elements or components are cited in different dependent claims does not exclude that at least some of these features, elements or components may be used in combination together.

The invention claimed is:

1. A machine for closing a tail end of a roll of web material comprising: a first glue-applying device for closing said tail end; and a second mechanical-closing device for mechanically sealing the tail end by anchoring the tail end of the roll to a portion of an outer turn of web material wound on the roll; wherein said first glue-applying device and said second mechanical-closing device are alternately operable to each other to separately seal said tail end to said roll.

2. The machine according to claim 1, wherein said second device comprises a plurality of mechanical ply-bonding members.

3. The machine according to claim 1, wherein said second device comprises a plurality of mechanical ply-bonding members.

4. The machine according to claim 2, wherein said mechanical ply-bonding members are arranged aligned with one another and with the tail end of the roll of web material.

5. The machine according to claim 3, wherein said mechanical ply-bonding members are arranged aligned with one another and with the tail end of the roll of web material.

6. The machine according to claim 2, wherein each of said plurality of mechanical ply-bonding members can move between an operating position and an idle position.

7. The machine according to claim 2, wherein each of said plurality of mechanical ply-bonding members comprises a mechanical ply-bonding roller.

8. The machine according to claim 1, wherein said first glue-applying device comprises a plurality of glue dispensing nozzles arranged and controlled so as to apply glue on the tail end of the roll.

9. The machine according to claim 8, wherein said glue dispensing nozzles are aligned with the tail end of the roll.

10. The machine according to claim 8, wherein said second mechanical-closing device comprises a plurality of mechanical ply-bonding members, and wherein a respective one of said plurality of mechanical ply-bonding members is associated with a respective one of said glue dispensing nozzles.

11. The machine according to claim 8, wherein each of said glue dispensing nozzles is carried by a slide.

12. The machine according to claim 8, wherein said glue dispensing nozzles have an adjustable inclination to apply glue alternatively on the tail end or on the cylindrical surface of the roll.

13. The machine according to claim 8, wherein at least one sensor is associated with each of said glue dispensing nozzles to detect presence of the tail end of the roll.

14. The machine according to claim 8, wherein two sensors are associated with each of said glue dispensing nozzles for detecting presence of the tail end of the roll, said two sensors being arranged at sides of the nozzle, and aligned with the tail end to be glued.

15. The machine according to claim 13, wherein each one of said glue dispensing nozzles is inhibited by a signal of a respective sensor when said sensor does not detect presence of the tail end to be closed.

16. The machine according to claim 8, wherein said nozzles are inhibited when said mechanical ply-bonding members are actuated, and vice versa.

17. A machine for closing a tail end of a roll of web material comprising: a first glue-applying device for closing said tail end; and a second mechanical-closing device for mechanically sealing the tail end by anchoring the tail end of the roll to a portion of an outer turn of web material wound on the roll, wherein said second device comprises a plurality of mechanical ply-bonding members, wherein each of said plurality of mechanical ply-bonding members comprises a mechanical ply-bonding roller, and wherein each said mechanical ply-bonding roller is carried by a respective slide which is provided with a synchronous movement parallel to the tail end to be closed.

18. The machine according to claim 17, wherein each said respective slide is mechanically connected with one another to move synchronously.

19. The machine according to claim 17, wherein each said respective slide carries an actuator respectively for pushing a respective one of said mechanical ply-bonding roller against a pressure and rolling surface, and carrying the mechanical ply-bonding roller in an idle position.

20. A machine for closing a tail end of a roll of web material comprising: a first glue-applying device for closing said tail end; and a second mechanical-closing device for mechanically sealing the tail end by anchoring the tail end of the roll to a portion of an outer turn of web material wound on the roll, wherein said second device comprises a plurality of mechanical ply-bonding members, wherein each of said plurality of mechanical ply-bonding members comprises a mechanical ply-bonding roller, and wherein each said mechanical ply-bonding roller comprises a first knurled annular portion, cooperating with said pressure and rolling surface; a second elastically yielding annular portion, cooperating with an embossing surface provided with an engraving, the web material pressed between the embossing surface and the second elastically yielding annular portion of each said mechanical ply-bonding roller being embossed with a pattern defined by said engraving.

* * * * *